United States Patent [19]

Kajihara et al.

[11] Patent Number: 4,800,320

[45] **Date of Patent: * Jan. 24, 1989**

[54] DISCHARGE TUBE FOR A HIGH PRESSURE METAL VAPOR DISCHARGE LAMP AND A METHOD OF MANUFACTURING THE SAME

[75] Inventors: Takehiro Kajihara, Komaki; Senji Atsumi, Kakamigahara; Hirotsugu Izumiya, Nagoya, all of Japan

[73] Assignee: NGK Insulators, Ltd., Nagoya, Japan

[ * ] Notice: The portion of the term of this patent subsequent to Aug. 18, 2004 has been disclaimed.

[21] Appl. No.: 55,144

[22] Filed: May 28, 1987

Related U.S. Application Data

[63] Continuation-in-part of Ser. No. 757,506, Aug. 31, 1984, Pat. No. 4,687,969.

[30] Foreign Application Priority Data

Aug. 31, 1984 [JP] Japan ..... 59-183294

[51] Int. Cl.[4] ..... H01J 17/18; H01J 61/36

[52] U.S. Cl. ..... 313/625; 313/636; 445/26

[58] Field of Search ..... 313/623, 624, 625, 636; 445/26, 29

[56] References Cited

U.S. PATENT DOCUMENTS

| | | | |
|---|---|---|---|
| 3,885,184 | 5/1975 | Schat et al. . | |
| 4,503,356 | 3/1985 | Kobayashi et al. | 313/636 X |
| 4,507,584 | 3/1985 | Coaton et al. | 313/625 X |
| 4,563,214 | 1/1986 | Seddon et al. | 313/636 X |
| 4,687,969 | 8/1987 | Kajihara et al. | 313/625 |

FOREIGN PATENT DOCUMENTS

| | | |
|---|---|---|
| 35507 | 3/1972 | Australia . |
| 0055532 | 4/1980 | European Pat. Off. . |
| 0009352 | 7/1982 | European Pat. Off. . |
| 0060582 | 9/1982 | European Pat. Off. . |
| 1923138 | 11/1969 | Fed. Rep. of Germany . |

OTHER PUBLICATIONS

"Lamps and Lighting" 2nd Ed. pp. 244–246, Henderson & Marsden Ed., Edward Arnold Publishers, London 1975.

*Primary Examiner*—David K. Moore
*Assistant Examiner*—K. Wieder
*Attorney, Agent, or Firm*—Parkhurst, Oliff & Berridge

[57] ABSTRACT

A discharge tube for a high pressure metal vapor discharge lamp is disclosed, which comprises a translucent alumina tubular body, first and second end plates of cermet having a firing shrinkage factor which is less than that of the translucent alumina tubular body, end first and second electrode support members partially embedded in inner sides of the first and second end plates, respectively. The first end plate is fitted to the first end portion of the alumina tubular body and bonded thereto through shrinkage fitting at a shrinkage fitting ratio of the tubular body to the first end plate being from 3 to 6% during a simultaneous sintering of the first end plate to the tubular body and a simultaneous bonding of the first electrode support member to the first end plate through shrinkage fitting at a shrinkage fitting ratio of the first end plate to the first electrode support member being from 4 to 16% when the alumina tubular body is fired to be translucent. The second end plate is fitted to the second opposite end portion of the tubular body and is bonded thereto by means of a frit. When the discharge lamp is in use, the second opposite end portion is located at a vertically higher position than the first opposite end portion. A method of producing such discharge tubes is also disclosed.

11 Claims, 1 Drawing Sheet

DISCHARGE TUBE FOR A HIGH PRESSURE METAL VAPOR DISCHARGE LAMP AND A METHOD OF MANUFACTURING THE SAME

This is a continuation-in-part application of Ser. No. 757,506 filed on Aug. 31, 1984, now U.S. Pat. No/ 4,687,969 claiming the convention priority of Japanese patent application No. 183,294/84.

BACKGROUND OF THE INVENTION (1) Field of the Invention

The present invention relates to high pressure metal vapor discharge lamps, particularly metal halide discharge tubes, and a method for manufacturing the same.

(2) Description of the Prior Art

A translucent alumina withstands corrosive metal halides, and is used for tubular bodies of high pressure metal vapor discharge lamps, particularly for tubular bodies of metal halide lamps in which a metal halide is sealingly placed. On the other hand, alumina or cermet is used for end plates adapted to fit electrode support members at end portions of the tubular body. When the discharge tube is to be produced by assembling these parts together, it is a common practice to bond the end plates to the opposite ends of the tubular body made of the transluscent alumina with a frit (for instance, U.S. Pat. Nos. 3,885,184 and 4,001,625). The tubular body has been made translucent through preliminary firing.

However, the use temperature of the discharge tube produced by such a method cannot be sufficiently raised since there is a fear that the frit is corroded with the metal halide, so that the discharge efficacy must unfavorably be suppressed to a level far lower than a theoretically calculated value. In addition, even if such is taken into consideration, only a relatively short durable life can be attained. Therefore, a method which allows easy production of discharge tubes for metal halide lamps which possess high discharge efficacy and long durable life has been demanded.

Summary of the Invention

The present invention therefore has been accomplished to resolve the above drawbacks encountered by the prior art, and is to provide discharge tubes for high pressure metal vapor discharge lamps, which have high discharge efficacy, and long durable life.

It is another object of the present invention to provide a method of manufacturing discharge tubes for high pressure metal vapor discharge lamps, which discharge tubes have high discharge efficacy and long durable life, said method comprises simplified steps.

According to the first aspect of the present invention, there is a provision of a discharge tube for a high pressure metal vapor discharge lamp, comprising: a translucent alumina tubular body having first and second opposite end portions; first and second end plates comprised of cermet, said cermet having a firing shrinkage factor which is less than a firing shrinkage factor of the translucent alumina tubular body; first and second electrode support members, said first support member being partially embedded in the first end plate and said second support member being partially embedded in the second end plate and each of said first and second electrode support members being located inside of the translucent alumina tubular body, said first end plate being fitted to the first opposite end portion of the translucent alumina tubular body and bonded thereto, said first opposite end portion being located at a lower position than the second opposite end portion when the high pressure metal vapor discharge lamp is in use, wherein bonding of the first end plate to the first opposite end portion is achieved by shrinkage fitting of the first end plate into the alumina tubular body at a shrinkage fitting ratio of the tubular body to the first end plate being from 3 to 6% during a simultaneous sintering of the first end plate to the translucent alumina tubular body and a similtaneous bonding of said first electrode support member to said first end plate through shrinkage fitting at a shrinkage fitting ratio of the first end plate to the first electrode support member being from 4 to 16%, said bonding occurring when the translucent alumina tubular body is fired to be translucent, said second end plate being fitted to the second opposite end portion of the translucent alumina tubular body and being bonded thereto by using a frit, said second opposite end portion being located at a vertically higher position than the first opposite end portion when the high pressure metal vapor discharge lamp is in use.

According to a second aspect of the present invention, there is a provision of a method of manufacturing a discharge tube for a high pressure metal discharge lamp, comprising: inserting a first end plate having a partially embedded electrode support member and a partially embedded electric current conductor into a first end portion of a tubular body, the tubular body comprising high purity alumina, such that the electrode support member may be positioned inside the tubular body and the electric current conductor may be positioned outside the tubular body, said first end plate comprising a cermet which has a firing shrinkage factor which is less than a firing shrinkage factor of the high purity alumina, said first end portion of the tubular body being located at a vertically lower position than a second end portion of the tubular body when the high pressure metal vapor discharge lap is in use; and firing the tubular body with said first end plate positioned therein, wherein when the tubular body is fired to become translucent, said first end plate is simultaneously shrink fitted inside of the tubular body and sealingly bonded to the tubular body by sintering at a shrinkage fitting ratio of the tubular body to the first end plate being from 3 to 6% and the partially embedded electrode support member and electric current conductor are simultaneously bonded to said end plate through shrinkage fitting at a shrinkage fitting ratio of the first end plate to the electrode support member and the electric current conductor being from 4 to 16%.

These and other objects, features and advantages of the invention will be well appreciated upon reading of the invention when taken in conjunction with the attached drawings with understanding that some modifications, variations and changes of the invention could be made by the skilled persons in the art to which the invention pertains without departing from the spirit of the invention or the scope of claims appended hereto.

BRIEF DESCRIPTION OF THE DRAWINGS

For better understanding of the invention, reference will be made to the attached drawings, wherein.

Figure 1:
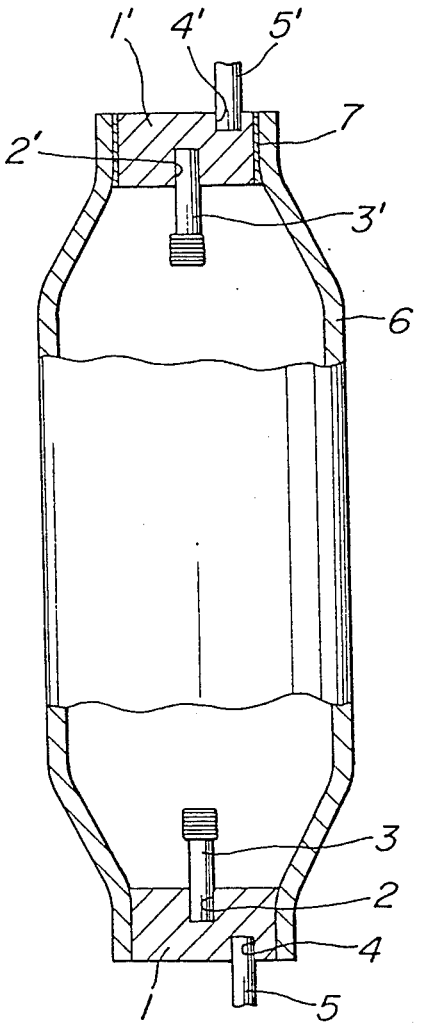
FIG. 1 is a partially cutaway front view of an embodiment of a discharge tube for a high pressure metal vapor discharge lamp according to the present invention.

Detailed Description of the Preferred Embodiments of the Invention

Now, the invention will be explained more in detail with referring to the attached drawings. Throughout the specification and the drawings, identical reference numerals denote the same or similar parts.

In FIG. 1, an embodiment of a discharge tube for a high pressure metal vapor discharge lamp is shown in which a reference numeral 1 is a first end plate, and a reference numeral 2 is a depression formed on the inner side of the end plate 1 into which an electrode support member 3 is fitted. The end plate 1 is bonded to a lower end of a tubular body 6. The tubular body 6 is made translucent through firing. An electric current conducting member 5 is fitted into a depression 4 formed in the end plate 1 on its outer side. A second end plate 1' is constituted in the same or a similar shape as the end plate 1, and possesses an electrode support member 3' and an electric current conducting member 5' which are fitted into depressions 2' and 4' formed at the inner and outer sides of the second end plates 1', respectively. This second end plate is attached to the upper end portion of the discharge tubular body 6 by means of a frit.

Next, a method of manufacturing the discharge tube for the high pressure metal vapor discharge lamp will be described more in detail below.

Figure 2:
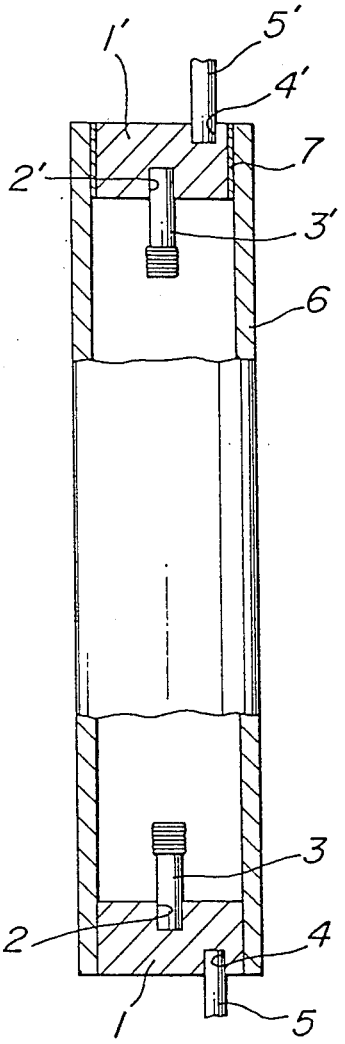
FIG. 2 is a modified embodiment of the discharge tube for the high pressure metal vapor discharge lamp according to the present invention.

First, a first end plate 1 is formed from a material of an excellent electric conductivity such as alumina-tungsten, alumina-molybdenum tungsten boride, etc. (cermet). Then, an electrode support member 3 is made of tungsten, and is inserted into a depression 2 provided on the inner side of the end plate 1. An electric current conductor 5 is inserted into the depression 4 formed on the outer side of the end plate 1 which is then calcined in a hydrogen atmosphere. On the other hand, a green tubular body is formed from high purity alumina, and is calcined in air. Then, the above end plate 1 is fitted into one end of the calcined tubular body, and the whole tubular body with the end plate 1 is fired at high temperatures around 1,900° C. in an electric furnace with a reducing atmosphere of hydrogen gas to make the tubular body to be translucent. At the same time, the end plate 1 is firmly bonded to the tubular body 6, and the electrode support member 3 and the electric current conductor 5 are sintered to the end plate 1 through firing. Since the firing shrinkage factor of the cermet constituting the end plate 1 is smaller than that of the high purity alumina constituting the tubular body 6, this bonding is carried out in the state of a certain shrinkage fitting, while a gas tight bonding is effected through a sintering phenomenon occurring between the end plate and the high purity alumina. A metal halide is sealingly put into the tubular body 6. When the lamp is in operation, the sealed substance becomes liquid. Accordingly, a chemical reactivity increases against the inner surface of the lower end portion of the tubular body. As mentioned above, since the end plate is directly bonded to the lower end of the tubular body 6 with using no frit, the lower end-bonded portion is prevented from being damaged. Finally, a second end plate 1' is preliminarily formed in the same way as mentioned above, and is equipped with an electrode support member 3' and an electric current conductor 5' under the same firing conditions. Then, the end plate 1' is bonded to the upper end portion of the tubular body 6 by means of a glass frit 7. Needless to say, the profile of the tubular body 6 may be a cylindrical tubular form as shown in FIG. 2 instead of that shown in FIG. 1.

A shrinkage fitting ratio (hereinafter defined) of the tubular body to the first end plate is from 3 to 6%, preferably from 4 to 5%. A shrinkage fitting ratio of the first end plate to the electrode supporting member and the electric current conductor is from 4 to 16%, preferably from 5 to 10%. The shrinkage fitting ratio is defined below, and is used throughout the specification and claims in this meaning.

$$\text{Shrinkage fitting ratio} = [(b-a)/a] \times 100(\%)$$

wherein "a" means an inner diameter of a hole provided in a member A (the tubular body and the first end plate) when the member A is fired at about 1,900° C. for 3 hours while no member is inserted into the hole, and "b" means an inner diameter of the member A when fired at the above temperature for 3 hours while a member B (the first end plate, the electrode support member, and the electric current conductor) is inserted into the hole of the member A. When the shrinkage fitting ratio of the tubular body to the first end plate is large, that of the first end plate to the electrode support member and the electric current conductor is set smaller, while when the former is small, the latter is set large. By so doing, excellent shrinkage fitting can be attained with respect to the tubular body, the first end plate, the electrode support member and the electric current conductor. Further, when the diameter of an electrode is smaller, cracks are difficult to occur in the tubular body and the first end plate even if the shrinkage fitting ratio is set larger. Thus, the shrinkage fitting ratio of the first end plate to the electrode support member and the electric current conductor is set wider as compared with that of the tubular body.

In the discharge tubes for the high pressure metal vapor discharge lamps according to the present invention, the following dimensions are generally employable:

- Outer diameter of the electrode support member: 0.4 to 0.8 mm
- Outer diameter of the electric current conductor: 0.7 to 1.3 mm
- Outer diameter of the end plates: 2 to 10 mm
- Thickness of the end plates: 3 to 8 mm
- Outer diameter of the end portions of the tubular body: 4 to 12 mm
- Inner diameter of the end portions of the tubular body: 2 to 10 mm
- Thickness of the end portions of the tubular body: 1.0 to 3.0 mm In order to demonstrate effects of the shrinkage fitting ratio, discharge tubes having the following dimensions and shrinkage fitting ratios in Table 1 were assembled, shrinkage fitted together by firing at about 1,900° C. for 3 hours, and then allowed to be cooled to room temperature. Thus, obtained discharge tubes were checked.

Dimensions of the discharge tubes:

- Outer diameter of the electrode support member: 0.5 mm
- Outer diameter of the electric current conductor: 1.0 mm
- Outer diameter of the end plates: 3.5 mm
- Thickness of the end plate: 5.0 mm
- Outer diameter of the end portions of the tubular body: 6.5 mm Inner diameter of the end portions of the tubular body: 3.5 mm Thickness of the end portions of the tubular body: 1.5 mm In the test, the electrode support members were made of tungsten, and the electric current conductors were also made of tungsten. The end plates were made of a cermet consisting of tungsten and alumina. As the tubular body, a translucent alumina was used.

TABLE 1

| | Sample No. | Shrinkage fitting ratio: first end plate to electrode support member | Shrinkage fitting ratio: first end plate to electric current conductor | Shrinkage fitting ratio: tubular body to first end plate | Test results | Remarks |
|---|---|---|---|---|---|---|
| Present invention | 1 | 4 | 4 | 6 | | good |
| | 2 | 5 | 5 | 5 | | good |
| | 3 | 10 | 8 | 4 | | good |
| | 4 | 16 | 10 | 3 | | good |
| Comparative Example | 5 | 3 | 3 | 6 | x | high contact resistance between electrode and first end plate |
| | 6 | 4 | 4 | 7 | x | cracks occurred at tubular body |
| | 7 | 18 | 12 | 3 | x | cracks occurred at first end plate |
| | 8 | 16 | 10 | 2 | x | gas leaked |

In Table 1, "O" means that no cracks occurred and no deterioration was observed in the discharge tube performance. On the other hand, "x" means that the discharge tube performance was deteriorated.

When the electric current conductors 5, 5' of the high pressure metal vapor discharge lamp thus produced are connected to an electric power source (not shown), electric current flows to the electrode support members 3 and 3' through the electric conductive end plates 1 and 1' to effect the discharging. At that time, the sealed substance is changed to liquid, but the bonded portion is not corroded with the liquid sealed substance having the high reactivity because the end plate 1 and the tubular body 6 are directly bonded together through sintering without using the frit at the end surface of the tubular body. Therefore, since the discharge tube can be used at temperatures higher than use temperatures of conventional discharge tubes of the metal halide discharge lamps, higher discharge efficacy can be obtained. In addition, a long durable life can be attained.

As obvious from the foregoing explanation, since the light transmission treatment by which the green or calcined tubular body made of a high purity alumina is made translucent through firing is carried out simultaneously with the bonding of the end plate with the tubular body, the discharge tube for a high pressure metal vapor discharge lamp having a high discharge efficacy and a longer durable life can be produced. Further, since the firing is not required to be done at plural stages, steps of the manufacturing method can be advantageously simplified. Therefore, the present invention can contribute to the development of the relevant industry to a large extent since the invention resolves the problems in the conventional methods of producing the discharge tubes for the high pressure metal vapor discharge lamps.

What is claimed is:

1. A discharge tube for a high pressure metal vapor discharge lamp, comprising:

a translucent alumina tubular body having first and second opposite end portions;

first and second end plates comprised of cermet, said cermet having a firing shrinkage factor which is less than a firing shrinkage factor of the translucent alumina tubular body;

first and second electrode support members, said first support member being partially embedded in the first end plate and said second support member being partially embedded in the second end plate and each of said first and second electrode support members being located inside of the translucent alumina tubular body, said first end plate being fitted to the first opposite end portion of the translucent alumina tubular body and bonded thereto, said first opposite end portion being located at a lower position than the second opposite end portion when the high pressure metal vapor discharge lamp is in use, wherein bonding of the first end plate to the first opposite end portion is achieved by shrinkage fitting of the first end plate into the alumina tubular body at a shrinkage fitting ratio of the tubular body to the first end plate being from 3 to 6% during a simultaneous sintering of the first end plate to the translucent alumina tubular body and a simultaneous bonding of said first electrode support member to said first end plate through shrinkage fitting at a shrinkage fitting ratio of the first end plate to the first electrode support member being from 4 to 16%, said bonding occurring when the translucent alumina tubular body is fired to be translucent, said second end plate being fitted to the second opposite end portion of the translucent alumina tubular body and being bonded thereto by using a frit, said second opposite end portion being located at a vertically higher position than the first opposite end portion when the high pressure metal vapor discharge lamp is in use.

2. A discharge tube for a high pressure metal vapor discharge lamp according to claim 1, wherein said shrinkage fitting ratio of the tubular body to the first end plate is from 4 to 5% and that of the first end plate to the first electrode support member is from 5 to 10%.

3. A discharge tube for a high pressure metal vapor discharge lamp according to claim 1, wherein the end plates are made of electric conductive cermet.

4. A discharge tube for a high pressure metal vapor discharge lamp according to claim 1, wherein an electric current conductor is attached to an outer side of each of the end plates.

5. A discharge tube for a high pressure metal vapor discharge lamp according to claim 3, wherein the electric current conductor is bonded to the outer side of said first end plate during said simultaneous sintering at a shrinkage fitting ratio of the first end plate to the electric current conductor being from 4 to 16%.

6. A discharge tube for a high pressure metal vapor discharge lamp according to claim 5, wherein the shrinkage fitting ratio of the first end plate to the electric current conductor is from 5 to 10%.

7. A discharge tube for a high pressure metal vapor discharge lamp according to claim 1, wherein said simultaneous sintering occurs at a temperature of about 1,900° C.

8. A method of manufacturing a discharge tube for a high pressure metal discharge lamp, comprising:

inserting a first end plate having a partially embedded electrode support member and a partially embedded electric current conductor into a first end portion of a tubular body, the tubular body comprising high purity alumina, such that the electrode support member may be positioned inside the tubular body and the electric current conductor may be positioned outside the tubular body, said first end plate comprising a cermet which has a firing shrinkage factor which is less than a firing shrinkage factor of the high purity alumina, said first end portion of the tubular body being located at a vertically lower position than a second end portion of the tubular body when the high pressure metal vapor discharge lamp is in use; and firing the tubular body with said first end plate positioned therein, wherein when the tubular body is fired to become translucent, said first end plate is simultaneously shrink fitted inside of the tubular body and sealingly bonded to the tubular body by sintering at a shrinkage fitting ratio of the tubular body to the first end plate being from 3 to 6% and the partially embedded electrode support member and electric current conductor are simultaneously bonded to said end plate through shrinkage fitting at a shrinkage fitting ratio of the first end plate to the electrode support member and the electric current conductor being from 4 to 16%.

9. A method of manufacturing a discharge tube for a high pressure metal vapor discharge lamp according to claim 8, wherein said shrinkage fitting ratio of the tubular body to the first end plate is from 4 to 5% and that of the first end plate to the first electrode support member and the electric current conductor is from 5 to 10%.

10. A method of manufacturing a discharge tube for a high pressure metal vapor discharge lamp according to claim 8, wherein a second end plate has an electrode support member partially embedded on an inner side thereof, and said second end plate is bonded with a glass frit to a second portion of the translucent alumina tubular body after said firing of the tubular body.

11. A method of manufacturing a discharge tube for a high pressure metal vapor discharge lamp according to claim 8, wherein said firing occurs at a temperature of about 1,900° C.

* * * * *